United States Patent [19]

Hemphill

[11] 4,049,433

[45] Sept. 20, 1977

[54] METHOD FOR THE HOMOGENEOUS DISTRIBUTION OF ALLOYS IN MOLTEN STEEL USING OIL AND WATER MIXTURES

[75] Inventor: J. Barry Hemphill, Mount Lebanon Township, Allegheny County, Pa.

[73] Assignee: United States Steel Corporation, Pittsburgh, Pa.

[21] Appl. No.: 728,685

[22] Filed: Oct. 1, 1976

[51] Int. Cl.[2] ..... C22C 33/04

[52] U.S. Cl. ..... 75/129; 75/53

[58] Field of Search ..... 75/53, 58, 129, 59, 75/51, 52

[56] References Cited

U.S. PATENT DOCUMENTS

| | | | |
|---|---|---|---|
| 3,556,773 | 1/1971 | Grenfell | 75/51 |
| 3,585,025 | 6/1971 | Obst | 75/53 |

*Primary Examiner*—P. D. Rosenberg

*Attorney, Agent, or Firm*—Arthur J. Greif

[57] ABSTRACT

In the addition of alloy additives to molten metal baths, under conditions in which there is an absence of substantial external stirring, such additives tend to distribute unevenly within the molten bath. Homogeneous distribution of such additives is achieved by first coating fragments of the alloy additive with a water-base mixture containing from about 2 to 30% oil dispersed therein and thereafter adding the fragments to the molten steel bath.

4 Claims, 2 Drawing Figures

Figure 1A:
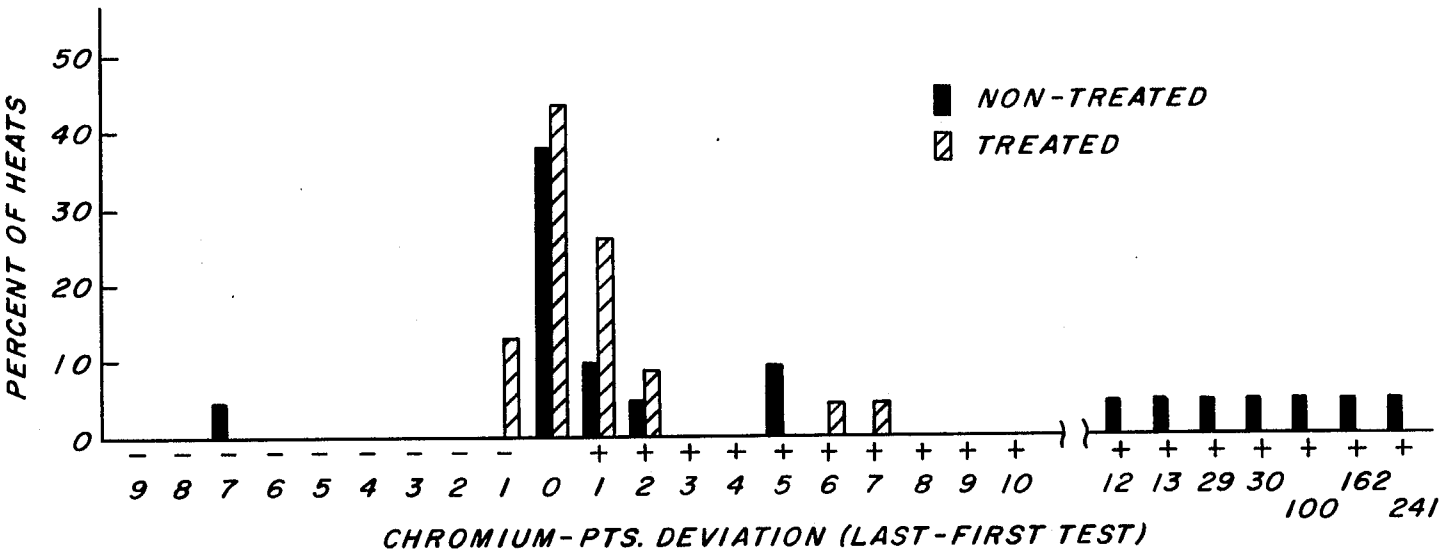

METHOD FOR THE HOMOGENEOUS DISTRIBUTION OF ALLOYS IN MOLTEN STEEL USING OIL AND WATER MIXTURES

This invention relates to the addition of fragmented, solid additives, such as deoxidation agents and alloy elements to molten metals, especially molten steel; and more particularly to a method for enhancing the homogeneous distribution of such additives within the molten metal.

In the production of metal ingots, a variety of chemical elements are added to the metal in the molten state to affect desirable results such as; improvement of mechanical and physical properties, improvement of corrosion resistance, control of grain size and in particular, with respect to the production of steel, to enhance the response of the steel to subsequent heat treatment. In steelmaking, such alloy additives may be added with the charge in the steelmaking furnace itself, or in the ladle into which the molten steel is tapped, or in the molds where the molten steel is subsequently teemed to affect the solidification thereof into ingots. The decision as to when such alloy additives are added is dependent on a number of factors. For example, comparatively non-oxidizable elements such as copper, molybdenum and nickel are generally added to the furnace. On the other hand, more readily oxidizable elements such as chromium, manganese and silicon are, to a large extent, added to the laddle. Pneumatic steelmaking processes because of their nature (i.e. the violent chemical reactions occurring therein and the stirring effected by the high-pressure oxygen jets), generally achieve a homogeneous distribution of the alloys added therein. Conversely, when alloy additives are added to massive melts (greater than 10 tons); such as additions to the ladle, difficulties are often encountered in achieving a uniform distribution of the elements throughout the molten bath. Newer steelmaking facilities have, at least in some cases, overcome this problem by providing for the offset tapping of the molten metal stream into the ladle, whereby adequate homogenization is achieved by the mechanical stirring effected by the swirling of stream itself. However, there still exist a number of older facilities in which the stream from the furnace is tapped essentially dead center into the ladle, whereby stirring by the stream is ineffective in achieving homogeneous distribution of alloy additives.

In those cases, either where there is a lack of sufficient mechanical stirring or where the alloy additives themselves are difficult to put into solution, the art has resorted to a variety of methods for augmenting such stirring by the production of exothermic chemical reactions or by the generation of chemically produced gases. For example, U.S. Pat. No. 2,935,397 shows the use of an aggregate composed of finely divided alloy additive and an organic binder therefor, which binder upon contact with the molten bath develops gaseous reaction products causing agitation of the melt promoting more rapid dissolution of the alloy additive. The formation of such aggregates obviously adds significantly to the cost of steel production. In U.S. Pat. No. 2,639,232, the alloy additives are coated with a wetting agent which promotes the formation of an oxide film on the surface of the additive, which film in turn permits the molten metal better to wet the surfaces of the alloy additive and more readily dissolve it. In U.S. Pat. No. 2,863,755, the alloy additive is coated with an oil which is capable of rapidly vaporizing when introduced into the molten metal. Apparently, from the disclosure of this patent, the use of such oil-coated particles has only been effective for enhancing the dissolution of calcium carbide in the desulfurization of molten steel. In a somewhat analogous but less expensive practice, water had been sprayed on ferroalloys before the addition thereof to molten steel. This practice, however, was only partially successful in that the water did not adhere well to the additive and would tend to evaporate before coming in contact with the molten metal. During cold weather, the use of water is additionally disadvantageous, in that the additive fragments tend to freeze and form large lumps, creating problems in plugging of the addition system.

It is therefore a principle object of the instant invention to provide an economical method for achieving homogeneous distribution of alloy additives in molten metal.

Figure 1B:
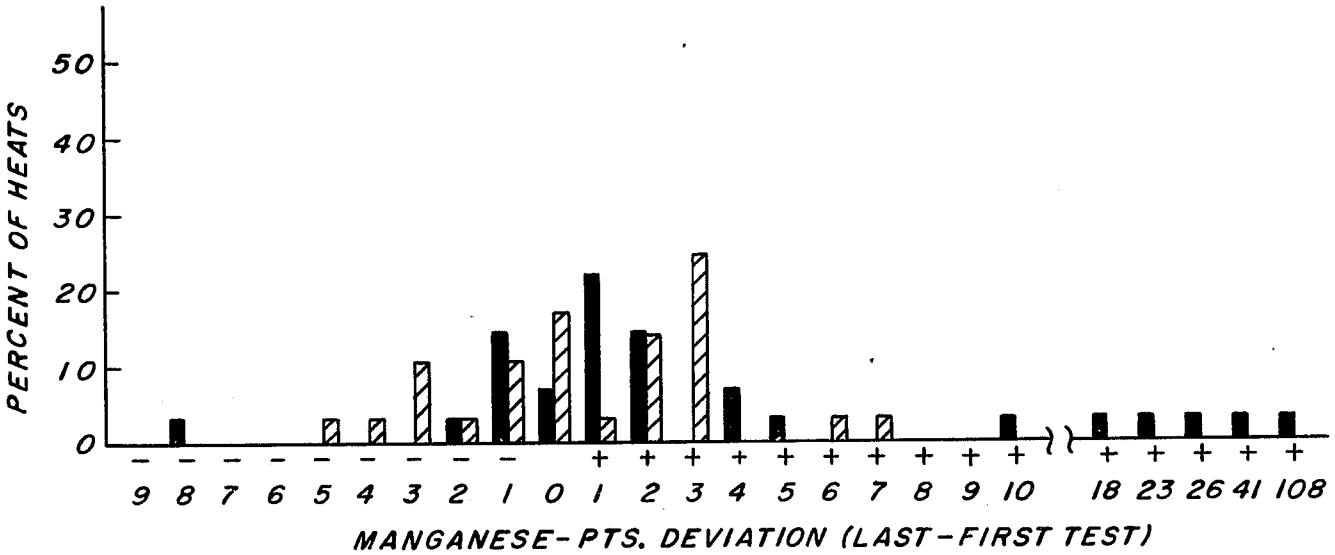

This and other objects of the instant invention will be more readily apparent from a reading of the following description when taken in conjunction with the appended claims and the drawings in which:

FIGS. 1(*a*) and (*b*) provide, for ferroalloy additives containing Cr and Mn respectively, a comparison of the distribution of such additives, achieved utilizing a coating of emulsifying oil in water vs. water only.

Initial studies were performed on 55 commercial size heats, with a nominal weight of about 220 tons per heat. Depending both on the actual size of the heat and the size of the ingots employed, such heats are normally teemed so as to produce from 20 to about 35 ingots. Conventionally, chemical samples are taken of the No. 3 ingot for a determination as to whether the heat ha met specification. For these tests, however, samples were taken of all the ingots, from the first to the last, so as to determine the deviation in the alloy additive from the front to the back of a heat. The deviation in chemical analysis for chromium and magnanese are reported for these 55 heats in FIGS. 1(*a*) and (*b*) respectively. In 28 of the heats, the alloy additives were coated utilizing an aqueous mixture containing 5% emulsifying cutting oil (SUNOCO SECO — a proprietary petroleum base oil containing lubricity agents, anti-rust agents, emulsifying agents and fatty oils), balance water. For comparison, 27 "control" heats of similar grade steels were coated with water alone. Referring to FIG. 1(*a*), it is seen that for heats treated according to the method of the instant invention, 91% of the heats exhibited a chromium deviation of ± 2 points ( a point equals 0.01 weight percent of the element in question). By contrast, for the control heats only about 53% fell within the range ± 2 points. More importantly, almost 40% of the control heats exhibited a deviation in excess of 10 points and about 15% thereof exhibited a deviation in excess of 100 points. Similar benefits were achieved with respect to the addition of manganese [FIG. 1(*b*)] wherein 84% of the heats treated according to the method of the instant invention exhibited a deviation of ± 3 points, whereas only about 63% of the control heats fell within this range. Here again, a significant number (greater than 15%) of the control heats exhibited a deviation in excess of 10 points. Subsequent to the work reported in FIGS. 1(*a*) and (*b*), similar alloy additives have been coated with a 5% mixture of conventional 20W hydraulic oil in water, with comparable success.

The invention may therefore be conducted in the following manner. The respective alloy additive is provided in particle or fragmented form. Desirably, a major portion of the fragments will be less than two inches in diameter, so as to facilitate rapid dissolution thereof. A mixture of oil and water which has been premixed so as to provide a dispersion of oil in water, is then applied to the respective alloy additive, by spraying, cascading, etc. to reasonably thoroughly coat the fragments and provide an aqueous film thereon. Desirably all alloy additives will be coated in a similar manner. However, when coated additives are added to the molten metal a turbulence is created, which not only aids the solution of the coated materials, but similarly will aid the solution of materials which were not so coated. Oil is dispersed in the water in amounts ranging from 2 to 30% of the total mixture. Even greater amounts of oil could be employed, but such a procedure would be costly and no further benefits are achieved thereby. To achieve maximal stirring, while realizing the full economic benefits of this invention, it is preferable to utilize oil in amounts ranging from about 3 to about 15% of the aqueous mixture.

From the above it is seen that the instant invention provides a simpler and more efficient method for the addition of alloy additives, especially with respect to economy, uniformity of alloy distribution throughout the melt, and good recovery of the additive. Since the alloy fragments, when added to the melt, are only coated with a thin aqueous film, the amount of extraneous material (in the water-oil mixture) is negligible, resulting in little or no risk of contaminating the steel melt. Although the above description has been specifically directed to the addition of alloy additives in the steel melt, it will readily be apparent that the instant invention will be capable of enhancing dissolution of solid additives to various other metal melts, as well.

I claim:

1. In the addition of alloy additive fragments to a massive molten metal bath, said addition being effected under conditions in which the degree of stirring of said bath is ineffective in achieving a homogeneous distribution of the additives within the bath, the improvement for significantly improving the homogeniety of said distribution, which comprises, prior to the addition of the additive to the molten bath, applying an aqueous mixture to said fragments so as to provide an aqueous film thereon, said mixture consisting essentially of 2 to 30 weight percent oil dispersed in water.

2. The method of claim 1, wherein said molten metal is steel and said fragments are steelmaking additives, containing principal amounts of oxidizable elements.

3. The method of claim 2, wherein said aqueous mixture consists essentially of 3 to 15% oil, emulsifying agents in an amount sufficient to effect the dispersion of at least a major portion of the oil, and the balance water.

4. The method of claim 2, wherein said oxidizable elements are selected from the group consisting of Mn, Cr, Si and Ca.

* * * * *